US005566418A

United States Patent [19]

Steffen et al.

[11] Patent Number: 5,566,418

[45] Date of Patent: Oct. 22, 1996

[54] BACK HAND

[76] Inventors: David H. Steffen, 4011 Monroe Rd., Allegan, Mich. 49010; George Spector, 233 Broadway Room 702, New York, N.Y. 10279

[21] Appl. No.: 539,217

[22] Filed: Oct. 5, 1995

[51] Int. Cl.[6] ..... A47K 7/02

[52] U.S. Cl. ..... 15/244.1; 15/144.1; 15/144.3; 15/144.4; 16/115; D28/7

[58] Field of Search ..... 15/144.1–144.4, 15/244.1, 244.2; D4/114, 124, 126, 137; D28/7, 63; D32/40, 43, 45, 50–52; 401/6; 16/115

[56] References Cited

U.S. PATENT DOCUMENTS

| | | | |
|---|---|---|---|
| D. 265,255 | 6/1982 | O'Neil | D28/7 |
| D. 267,671 | 1/1983 | Kupchik | D28/63 |
| D. 342,342 | 12/1993 | Maglione | D28/7 |
| D. 366,727 | 1/1996 | Possmann | D28/7 |
| D. 367,137 | 2/1996 | Pollak et al. | D28/7 |
| 579,277 | 3/1897 | Lord et al. | 16/115 |
| 1,973,768 | 9/1934 | Knapp | 15/144.3 |
| 2,091,495 | 8/1937 | Steen | 16/115 |
| 2,932,047 | 4/1960 | Johnston | 15/144.1 |
| 2,936,475 | 5/1960 | Johns | 15/144.4 |
| 3,103,682 | 9/1963 | Markle | 15/244.1 |
| 4,299,005 | 11/1981 | Brown | 15/244.2 |
| 4,396,028 | 8/1983 | Waggoner | 15/144.4 |
| 4,483,356 | 11/1984 | Kales | 401/6 |
| 4,861,180 | 8/1989 | Adams | 401/6 |
| 5,207,755 | 5/1993 | Ampian | 15/144.1 |
| 5,360,111 | 11/1994 | Arispe | D28/7 |

FOREIGN PATENT DOCUMENTS

| | | | |
|---|---|---|---|
| 2852490 | 6/1980 | Germany | 401/6 |
| 3427079 | 1/1986 | Germany | 401/6 |

*Primary Examiner*—Mark Spisich

[57] ABSTRACT

An improved lotion applicator comprises an extendable arm and an applicator member affixed to the extendable arm. A person can grip the extendable arm opposite from the applicator member, to reach the back and hard to reach areas of the body with the applicator member for applying lotion thereto.

9 Claims, 1 Drawing Sheet

BACK HAND

BACKGROUND OF THE INVENTION

The instant invention relates generally to liquid applying devices and more specifically it relates to an improved lotion applicator, which provides a simulated human hand applicator at a distal end of an extendable arm, to reach the back and hard to reach areas of the body.

There are available various conventional liquid applying devices which do not provide the novel improvements of the invention herein disclosed.

SUMMARY OF THE INVENTION

A primary object of the present invention is to provide an improved lotion applicator that will overcome the shortcomings of the prior art devices.

Another object is to provide an improved lotion applicator having a simulated human hand applicator member made out of a foam rubber material, for applying a lotion to the back and hard to reach areas of the body.

An additional object is to provide an improved lotion applicator having an extendable arm to carry the simulated human hand applicator member, so that a person can reach the back and hard to reach areas of the body to apply the lotion thereto.

A further object is to provide an improved lotion applicator that is simple and easy to use.

A still further object is to provide an improved lotion applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
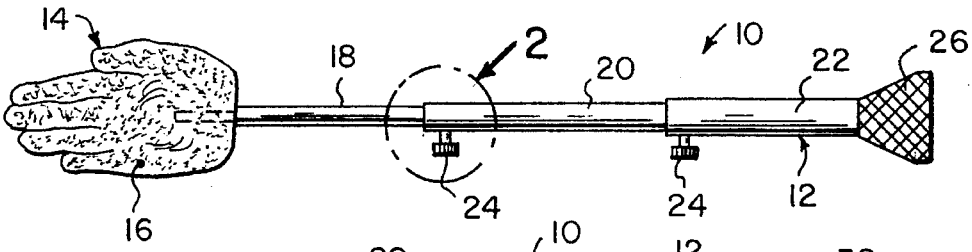
FIG. 1 is a plan view of a first embodiment of the instant invention.

Turning now descriptively to the drawings, in which similar reference characters denote similar elements throughout the several views, FIGS. 1 through 7 illustrate an improved lotion applicator 10 comprising an extendable arm 12 and an applicator member 14 affixed to the extendable arm 12. A person can grip the extendable arm 12 opposite from the applicator member 14, to reach the back and hard to reach areas of the body with the applicator member 14 for applying lotion thereto. The applicator member 14 is made out of foam rubber 16 and is shaped as a simulated human hand with a cupped palm, to better apply the lotion to the back and the hard to reach areas of the body.

Figure 2:
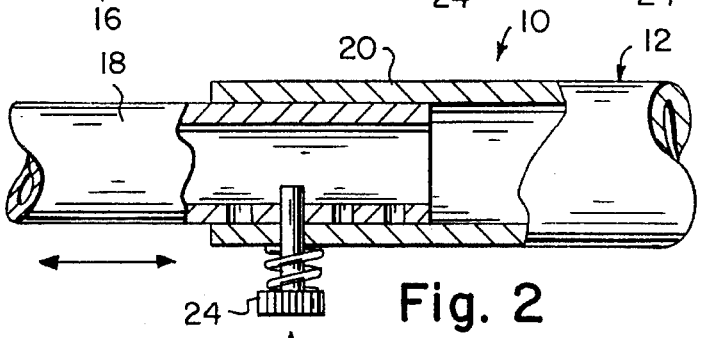
FIG. 2 is an enlarged plan view with parts broken away and in section as indicated by arrow 2 in FIG. 1, showing one of the pull pins in greater detail for the telescopic segments of the arm.

The extendable arm 12, as shown in FIGS. 1 and 2, includes a plurality of telescopic segments 18, 20 and 22, which slide into each other. A plurality of spring biased pull pins 24 are provided, for retaining the telescopic segments 18, 20 and 22 in their extended positions. A handgrip 26 is on the telescopic segment 22 opposite from the applicator member 14.

Figure 4:
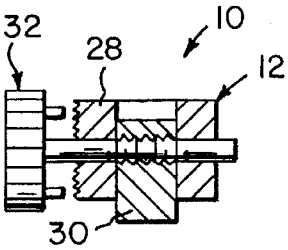
FIG. 4 is an enlarged cross sectional view taken along line 4—4 in FIG. 3, showing the locking pivot bolt clamp assembly in greater detail.
Figure 3:
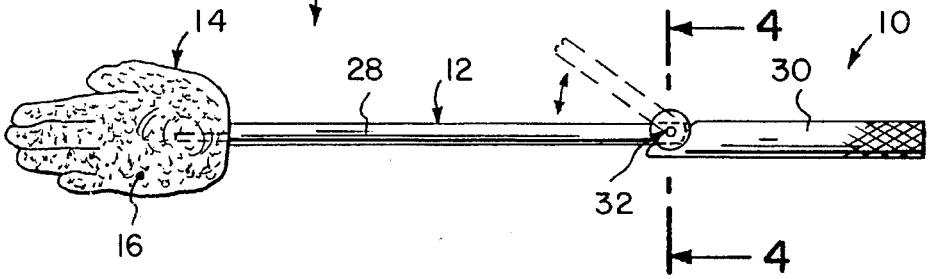
FIG. 3 is a plan view of a second embodiment of the instant invention.

The extendable arm 12, as shown in FIG. 3 and 4, consists of an elongated handle 28 having the applicator member 14 affixed thereto. A handgrip 30 is also provided. A locking pivot bolt clamp assembly 32 is for attaching the elongated handle 28 to the handgrip 30. The elongated handle 28 can be angularly positioned and locked with respect to the handgrip 30.

Figure 5:
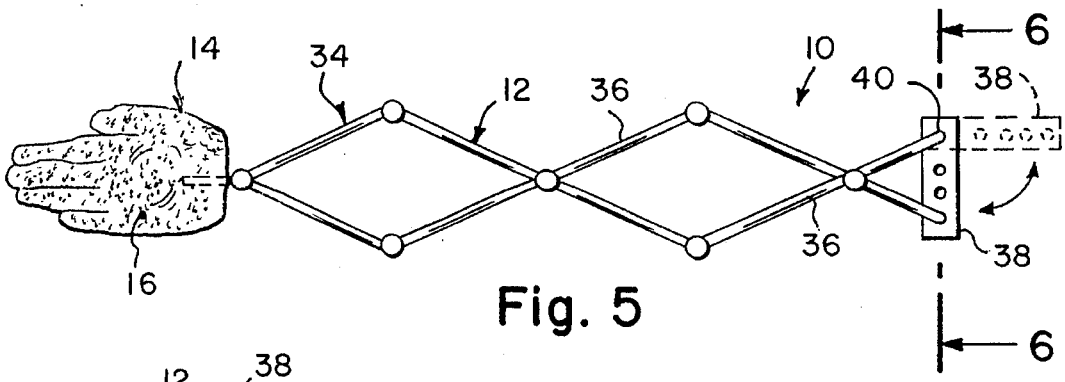
FIG. 5 is a plan view of a third embodiment of the instant invention.
Figure 6:
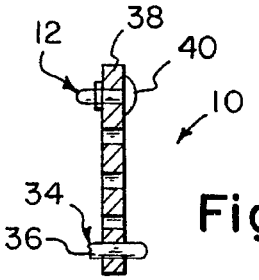
FIG. 6 is an enlarged cross sectional view taken along line 6—6 in FIG. 5, showing an adjustable handgrip bar for the scissor-type handle.

The extendable arm 12, as shown in FIGS. 5 and 6, comprises a scissor-type handle 34 having a plurality of interconnecting pivotable segments 36. A handgrip bar 38 is mounted at 40 in a pivotable and adjustable manner to the scissor-type handle 34 opposite from the applicator member 14. The handgrip bar 38 will extend and lock said scissor-type handle 34 at different lengths when adjusted thereto.

Figure 7:
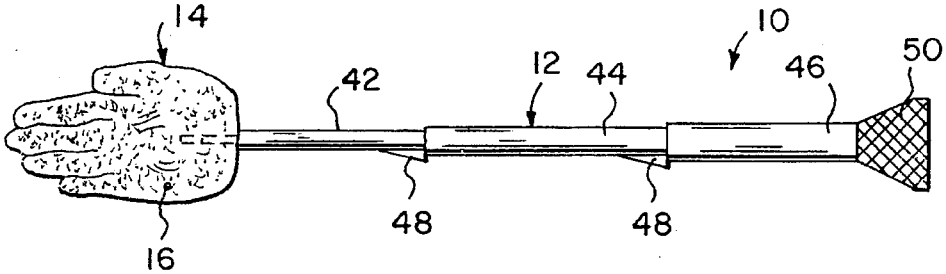
FIG. 7 is a plan view of a fourth embodiment of the instant invention.

The extendable arm 12 in FIG. 7, includes a plurality of telescopic segments 42, 44 and 46, which slide into each other. A plurality of umbrella-type spring latches 48 are for retaining the telescopic segments 42, 44 and 46 in their extended positions. A handgrip 50 is on the telescopic segment 46 opposite from the applicator member 14.

The extendable arm 12 can be made from at least one material selected from the group consisting of bamboo, plastic, hard rubber, wood, aluminum and any other durable strong material.

OPERATION OF THE INVENTION

To use the improved lotion applicator 10 in FIGS. 1 and 2, a person simply extends the telescopic segments 18, 20 and 22, so that the spring biased pull pins 24 will retains them in the extended position. The handgrip 26 is then grasped by the hand, so that the applicator member 14 can be maneuvered to apply the lotion to the back and the hand to reach areas of the body.

To use the improved lotion applicator 10 in FIGS. 3 and 4, a person simply extends the elongated handle 28 at any angle from the handgrip 30 and locks it with the locking pivot bolt clamp assembly 32. The handgrip 30 is then grasped by the hand, so that the applicator member 14 can be maneuvered to apply the lotion to the back and the hard to reach areas of the body.

To use the improved lotion applicator 10 in FIGS. 5 and 6, a person simply extends the scissor-type handle 34 to any desired length and then locks it in place with the handgrip bar 38. The handgrip bar 38 is then grasped by the hand, so that the applicator member 14 can be maneuvered to apply the lotion to the back and the hard to reach areas of the body.

To use the improved lotion applicator 10 in FIG. 7, a person simply extends the telescopic segments 42, 44 and 46, so that the umbrella-type spring latches will retain them in the extended position. The hand grip 50 is then grasped by the hand, so that the applicator member 14 can be maneuvered, to apply the lotion to the back and the hard to reach areas of the body.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lotion applicator comprising:

(a) a foam rubber applicator member shaped to resemble a human hand, to apply lotion to the body of the user;

(b) an extendable arm to which said applicator is affixed, said extendable arm comprising at least one pair of hollow tubular telescopic segments which are adapted to slide relative to each other, each pair of segments further comprising a first segment having a plurality of holes extending through and disposed along a wall thereof, said first segment being slidably received within a second segment having a hole through a wall thereof, the hole in the second segment receives a pull pin, said pull pin comprising an elongated pin having an enlarged head at one end thereof, a spring disposed between the outer peripheral wall of the second segment and the enlarged head of the pull pin, the elongated pin of the pull pin being adapted to engage a selected one of the holes of the first segment so that the segments may be fixed at a plurality of positions, a hand grip positioned on an end of the segment at an extreme proximal end of said extendable arm and said applicator member positioned on the segment at an extreme distal end of said extendable arm; and (c) whereby the user can more easily reach the back and hard to reach areas of the body with said applicator member for applying lotion thereto.

2. A lotion applicator comprising:

(a) a foam rubber applicator member shaped to resemble a human hand, to apply lotion to the body of the user;

(b) an extendable arm to which the applicator member is affixed, said extendable arm comprising a scissor-type handle having a plurality of interconnecting pivotal segments, said applicator member being fixed to a distal end of said extendable arm and a handgrip bar being fixed to a proximal end of the extendable arm, said handgrip bar being pivotably attached to one of said segments and including a plurality of holes spaced along the length thereof, another one of said segments adjacent said handgrip bar including means to engage a selected one of the holes in the handgrip bar so that said handgrip bar will extend and lock said scissor-type handle at different lengths when adjusted thereto; and (c) whereby the user can more easily reach the back and hard to reach areas of the body with said applicator member for applying lotion thereto.

3. A lotion applicator comprising:

(a) a foam rubber applicator member shaped to resemble a human hand, to apply lotion to the body of the user;

(b) a elongated hollow tubular member having a first end fixed to said applicator member and an opposite second end, an elongated handgrip having an end thereof pivotally connected to the second end of the tubular member, at least a portion of the end of the handgrip being located between adjacent spaced-apart walls of the tubular mender at the second end thereof, the handgrip and the spaced-apart walls of the tubular member each having a hole extending therethrough, a locking pivot bolt clamp assembly comprising an elongated pin which is received in the holes of the spaced-apart walls of the tubular member as well as the hole in the handgrip and further wherein there is am enlarged head at an end of said elongated pin, said enlarged head and an outer portion of one of the spaced-apart walls of the tubular member including means to angularly position and lock the handgrip with respect to the tubular member; and (c) whereby the user can more easily reach the back and hard to reach areas of the body with said applicator member for applying lotion thereto.

4. The lotion applicator as recited in claim 1, wherein the hand-shaped applicator member includes a cupped palm portion.

5. The lotion applicator as recited in claim 2, wherein the hand-shaped applicator member includes a cupped palm portion.

6. The lotion applicator as recited in claim 3, wherein the hand-shaped applicator member includes a cupped palm portion.

7. The lotion applicator as recited in claim 1, wherein the extendable arm is made from at least one material selected from the group consisting of bamboo, plastic, hard rubber, wood, aluminum and any other durable strong material.

8. The lotion applicator as recited in claim 2, wherein the extendable arm is made from at least one material selected from the group consisting of bamboo, plastic, hard rubber, wood, aluminum and any other durable strong material.

9. The lotion applicator as recited in claim 3, wherein the elongated tubular member and handgrip are made from at least one material selected from the group consisting of bamboo, plastic, hard rubber, wood, aluminum and any other durable strong material.

* * * * *